US005392723A

United States Patent [19]

Kaju

[11] Patent Number: 5,392,723

[45] Date of Patent: Feb. 28, 1995

[54] TUFTING MACHINE AND METHOD FOR PRODUCING DESIGN IN CARPETING AND THE LIKE

[75] Inventor: Sadayoshi Kaju, Osaka, Japan

[73] Assignee: Ohno Co., Ltd., Sakai, Japan

[21] Appl. No.: 241,690

[22] Filed: May 12, 1994

Related U.S. Application Data

[63] Continuation of Ser. No. 61,819, May 13, 1993, abandoned, which is a continuation of Ser. No. 983,096, Nov. 27, 1992, abandoned, which is a continuation of Ser. No. 676,208, Mar. 27, 1991, abandoned.

[30] Foreign Application Priority Data

Apr. 13, 1990 [JP] Japan ..... 2-97842

[51] Int. Cl.[6] ..... D05C 15/26

[52] U.S. Cl. ..... 112/80.23; 112/80.41; 112/80.43; 112/80.44; 112/80.32

[58] Field of Search ..... 112/80.3, 80.31, 80.32, 112/80.23, 80.24, 80.4, 80.41, 80.43, 80.44, 460, 319

[56] References Cited

U.S. PATENT DOCUMENTS

| | | | |
|---|---|---|---|
| 3,016,029 | 1/1962 | Card . | |
| 3,026,830 | 3/1962 | Bryant et al. . | |
| 3,056,364 | 10/1962 | Dedmon . | |
| 3,067,701 | 12/1962 | Wilcox . | |
| 3,177,833 | 4/1965 | Passons . | |
| 3,203,388 | 8/1965 | Parlin et al. . | |
| 3,272,163 | 9/1966 | Erwin, Jr. et al. . | |
| 3,393,654 | 7/1968 | Barnes . | |
| 3,396,687 | 8/1968 | Nowicki . | |
| 3,433,188 | 3/1969 | Pickles . | |
| 3,435,787 | 4/1969 | Short . | |
| 3,547,058 | 12/1970 | Brown et al. . | |
| 3,577,943 | 5/1971 | Watkins . | |
| 3,934,524 | 1/1976 | Smith | 112/80.3 X |
| 4,244,309 | 1/1981 | Spanel et al. . | |
| 4,549,496 | 10/1985 | Kile . | |
| 4,831,948 | 5/1989 | Itoh et al. | 112/80.43 |

FOREIGN PATENT DOCUMENTS

| | | | |
|---|---|---|---|
| 53612 | 12/1990 | Australia . | |
| 3028413 | 3/1981 | Germany . | |
| 3811330 | 12/1988 | Germany . | |
| 46-14227 | 4/1971 | Japan . | |
| 54-10905 | 5/1979 | Japan . | |
| 57-43662 | 9/1982 | Japan . | |
| 59-179863 | 10/1984 | Japan . | |
| 60-39466 | 3/1985 | Japan . | |
| 60-88166 | 5/1985 | Japan . | |
| 63-135553 | 6/1988 | Japan . | |
| 63-256763 | 10/1988 | Japan | 112/80.43 |
| 526669 | 9/1972 | Switzerland . | |
| 1178534 | 1/1970 | United Kingdom . | |
| 1503352 | 3/1978 | United Kingdom . | |
| 2052101 | 1/1981 | United Kingdom . | |
| 2061336 | 5/1981 | United Kingdom . | |
| 89/09300 | 10/1989 | WIPO . | |

*Primary Examiner*—Peter Nerbun
*Assistant Examiner*—Paul C. Lewis
*Attorney, Agent, or Firm*—Darby & Darby

[57] ABSTRACT

An intermittent drive for a backing fabric feed is applied to a tufting machine together with a needle select apparatus, a pattern control, and a mechanism for laterally shifting a needle or the backing fabric. The intermittent drive moves the backing fabric feed in such a manner as to continuously stop the feed roller and the take-up roller over several needle stroke cycles, and to drive those rollers while the needle is not yet in the backing fabric in the first needle stroke cycle just after the stop. The pattern control provides the needle select apparatus with a signal so that of the needles can be selected and brought into the tufting engagement with the looper disposed under the laterally shifted needles to seize only one loop of pile yarn in any one of the needle stroke cycles of each periodic time of a stop and feed motion of the intermittent drive feed for the backing fabric.

4 Claims, 7 Drawing Sheets

TUFTING MACHINE AND METHOD FOR PRODUCING DESIGN IN CARPETING AND THE LIKE

This is a continuation, of application Ser. No. 08/061,819, filed May 13, 1993, now abandoned, which is in turn a continuation of application Ser. No. 07/983,096, filed Nov. 27, 1992, now abandoned, which is in turn a continuation of application Ser. No. 07/676,208, filed Mar. 27, 1991, now abandoned.

BACKGROUND OF THE INVENTION

This invention relates to a tufting technique in which a pile of tufted carpet is formed from a pile yarn inserted with a needle into the backing fabric and fastened with a looper.

On a tufting machine the backing fabric is fed continuously and straightway in the stitching direction so that a series of piles of each pile yarn is formed alining straightway in the stitching direction.

According to the prior art, a colored pattern on the pile surface is produced by varying the length or amount of pile yarn fed to the needle in every needle stroke cycle, and by stiching selectively the needles into the backing fabric in every needle stroke cycle.

In U.S. Pat. Nos. 3,016,029, 3,067,701, 3,272,163, 3,433,188 and 3,435,787, there are disclosed pattern apparatuses composed of a feed roller for varying the length of pile yarn fed to the needle and a pattern control apparatus for actuating the feed roller.

According to these pattern apparatuses, a pattern classified with two colors is duplicated on the surface of tufted carpet by alternately threading a plurality of pairs of pile yarns respectively of different color into a plurality of needles lateraly alined, and by controling the length of these yarns fed in every needle stroke cycle in a manner to increase the length of one of each pair of pile yarns to form a high pile and to decrease the length of another of each pair of pile yarns to form a low pile to be hid under the high pile formed adjacent to it.

In U.S. Pat. Nos. 3,056,364, 3,177,833, and 3,547,058, Japanese Patent publications No. sho 46-14227, No. sho 54-10905, and No. sho 57-43662, and Japanese Laid-Opens No. sho 59-179863, No. sho 60-39466, No. sho 60-88166, No. sho 63-13553, there are disclosed other kinds of pattern apparatuses for driving a plurality of needles by selecting, in every needle stroke cycle, whether to insert into the backing fabric or not.

According to these pattern apparatuses, a pattern classified in two colors is duplicated on the pile surface by alternately threading two kinds of pile yarns colored respectively in different colors into a plurality of needles lateraly aligned, by selecting one of each pair of two needles adjacent to each other in every needle stroke cycle, and by stitching the selected one of each pair of two needles into the backing fabric to form piles.

This kind of tufting machines, comprising a pattern control means and a needle select means adapted to duplicate a pattern on the pile surface by selectively inserting each needle into the backing fabric in every needle stroke cycle, are sold by Cobble Tufting Machine Company in Sakai-city, Osaka, Japan.

According to the prior art, it is possible to duplicate a pattern classified in two colors, but it is impossible to duplicate more colorful and various patterns such as Wilton type carpets and Axminster type carpets.

In U.S. Pat. Nos. 3,026,830, 3,396,687, 3,203,388, 3,393,654, and 3,577,943, there is disclosed shift apparatuses for zig-zag tufting a series of piles in the stitching direction by laterally shifting a needle or the backing fabric in every needle stroke cycle.

The shift apparatuses are applied to the tufting machine as a means for avoiding an unsightly stripe, which is one kind of fault caused by unevenness in color or thickness of pile yarn, from the pile surface, and for drawing a comparatively simple pattern, such as pepper-salt pattern, on the pile surface. But, a relatively wide variety pattern could not be drawn with the shift apparatus.

Further, in accordance with the prior art, if the shift apparatus had been applied to the tufting machine together with the above pattern apparatuses to duplicate a classified pattern on the pile surface, the contour line of the pattern would be drawn in a zig-zag line and would become indistinct.

As a result, the shift apparatus had not been used applied together with the pattern apparatus for duplicating a pattern to be made in two colors.

SUMMARY OF THE INVENTION

It is an object of the present invention to duplicate such a colorful and variety pattern as is drawn in wilton carpets and Axminster type carpets by applying a well known needle select apparatus, a well known pattern control apparatus, a well known needle or cloth shift apparatus, and the like.

Another object of the present invention is to draw more efficiently a colorful and variety pattern on the pile surface with the tufting machine than with the Wilton loom and the Axminster loom.

In accordance with this invention, these objects are achieved by applying to the tufting machine an intermittent apparatus for intermittently driving a backing fabric feed apparatus together with a well known needle select apparatus, together with a well known pattern control apparatus, and together with a well known shift apparatus for laterally shifting a needle or the backing fabric.

The intermittent apparatus is applied to drive a backing fabric feed apparatus in such a manner as to continuously stop the feed roller and the take-up roller, both of which form a backing fabric feed apparatus, over several needle stroke cycles, and in such a manner as to drive those rollers while a needle is not yet in the backing fabric in the first needle stroke cycle just after the stop.

DETAILED DESCRIPTION OF THE INVENTION

Figure 1:
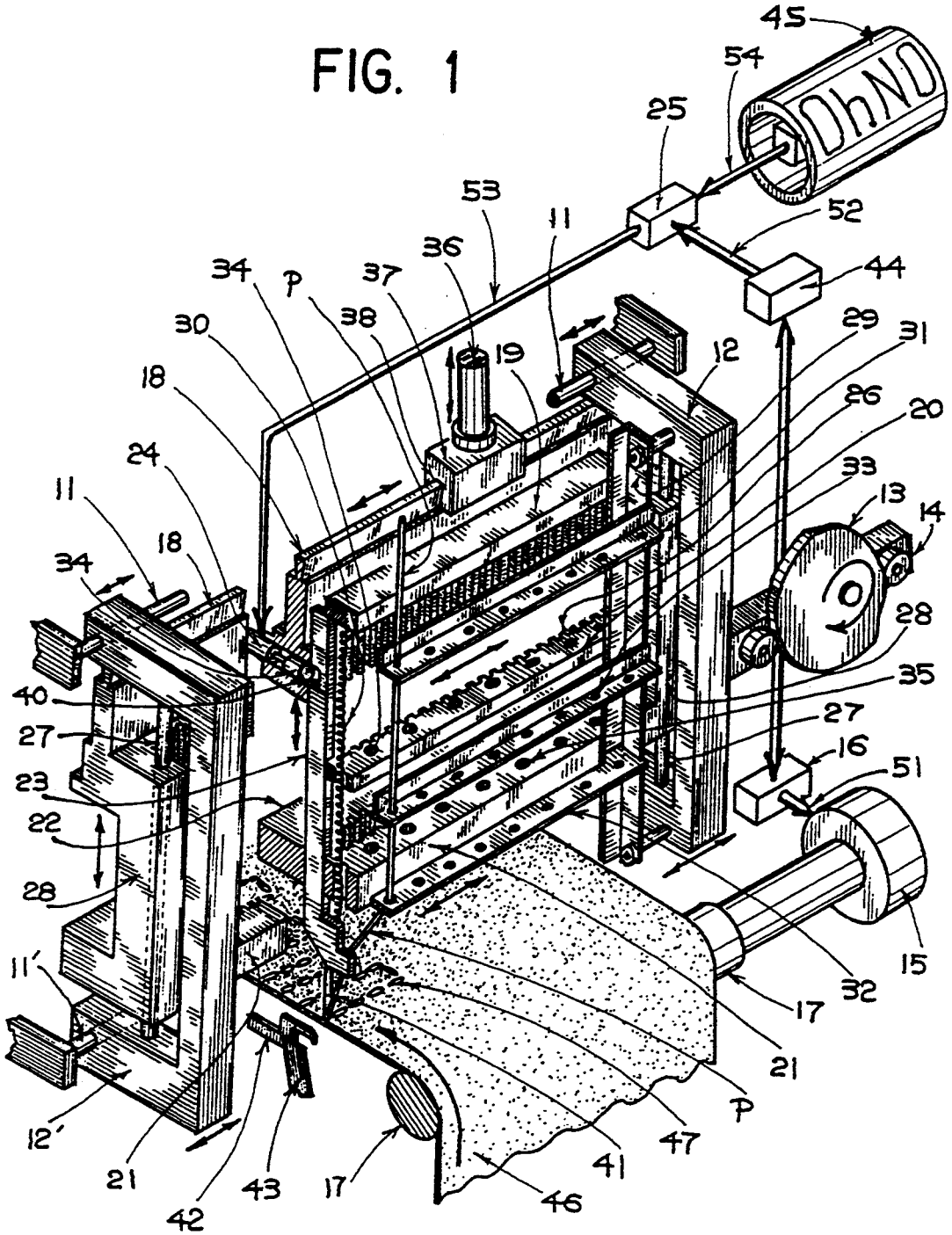
FIG. 1 is a fragmentary perspective view of a tufting machine in accordance with this invention, which shows a modeled pattern control mechanism.

The tufting machine, in accordance with this invention, comprises a plurality of needles aligned lateraly of the machine at a regular gauge between adjacent needles, a plurality of loopers aligned lateraly of the machine at the same gauge between adjacent loopers as that of the needles, a needle select means for selecting each of the needles in every needle stroke cycle and for inserting the selected needles into the backing fabric, a pattern control means for providing a signal for actuating the needle select means to select and insert the needles, an intermittent reed means for intermittently and longitudinally feeding the backing fabric in a stop and feed manner wherein the backing fabric remains stationary in the longitudinal direction during several needle stroke cycles and can be fed in a needle stroke cycle, and a shift means for effecting a relative lateral shifting movement between the needles and the backing fabric.

The shift apparatus is adjustable to shift the needles or the backing fabric a distance equivalent to a needle gauge in every needle stroke cycle while the backing fabric is not fed by the intermittent feed means and remains stationary in the longitudinal direction.

The pattern control apparatus is adjustable to provide the needle select apparatus with a signal, with which any one of the needles may be selected, inserted and then brought into the tufting engagement with the looper disposed under the lateraly shifted needles in any one of needle stroke cycles of each periodic time of a stop and feed motion of the intermittent feed means, and thereby all loopers seize only one loop of pile yarn from any one of the needles shifted, passing and disposed over the looper in each periodic time of a stop and feed motion of the intermittent feed means.

A pattern is duplicated on the pile surface, in accordance with the pattern control apparatus, by laterally shifting the needles or the backing fabric a distance equivalent to the needle gauge with the shift means when the needles are not yet in the backing fabric in each needle stroke cycle, and by providing the needle select apparatus with a signal, with which every looper is to be actuated to seize only one loop of pile yarn from only one of the needles lateraly shifted and disposed over the looper to seize only one loop of pile yarn in each periodic time of a step and feed motion of the intermittent feed means.

Pile yarns composed of several sets of different colors and divided into several groups, each of which is respectively composed of several pile yarns, the number of which is equal to the number of the sets of pile yarn, and which varies in color.

And, those pile yarns of each group are arranged in order of the difference of their color in a manner wherein the arrangement of each group is similar to one another.

And, those arranged pile yarns are respectively threaded into the corresponding needles laterally aligned at the same gauge according to the order of their arrangement in each group.

The number of the needle stroke cycle of each periodic time of a stop and feed motion is fixed so that the number of the needle stroke cycles of each periodic time becomes equivalent to that of sets of pile yarns.

Therefore, the number of the needle stroke cycles in each periodic time for stopping the feeding of the backing fabric in the longitudinal direction with intermittent feed apparatus is equal to the number which is one less than, that is taken one from, the number of sets of pile yarns.

Conventional drive apparatus composed of a rooter, a crank mechanism, and the like, and conventional needle select apparatus may be used to form piles in accordance with cooperating engagement between loopers and needles, conventional pattern control apparatus may be used to generate a control signal for actuating the needle select apparatus, and conventional shift apparatus may be used laterally to shift the needles or the backing fabric.

The intermittent feed apparatus may be composed by applying such a conventional intermittent drive mechanism as geneva gear, servo motor, clutch-in-roll, and the like, to the feed roller and the take-up roller of the tufting machine.

In accordance with the present invention, the backing fabric remains stationary in the longitudinal detection over several needle stroke cycles in each periodic time of a stop and feed motion of intermittent feed apparatus, but all needles are laterally shifted as a unit a distance equivalent to a needle or looper gauge in every needle stroke cycle while the backing fabric is stationary.

Therefore, if all needles should, in accordance with the prior art, be inserted into the backing fabric in every needle stroke cycle while the backing fabric is stationary, every looper might seize a loop of pile yarn respectively from several needles shifted and passing over each looper, and consequently every looper should be obliged to seize the several loops of pile yarn, the number of which become equal to that of needle stroke cycles or that of needles passing over a single looper in each periodic time of a stop and feed motion of intermittent feed apparatus.

However, in accordance with the invention, the pattern control means is adapted to provide the needle select means with a control signal, with which any one of those several needles shifted and passing over the single looper, is selected, inserted into the backing fabric, and then brought into the tufting engagement with the looper which is disposed under the several needles while they were shifted in each periodic time of a stop and feed motion of intermittent feed apparatus, and thereby every looper can seize only one loop of pile yarn in any one of several needle stroke cycles composing a periodic time of a stop and feed motion of intermittent feed apparatus.

That is, in this way, it is fixed about all needles whether to be inserted into the backing fabric or not, in each needle stroke cycle, and each looper seizes only one loop of pile yarn from any one of the several needles in each periodic time of a stop and feed motion of intermittent feed apparatus.

Therefore, if the several needles, all of which are shifted as a unit, carry one of the several pile yarns respectively which vary in colors, each looper is to seize a loop of pile yarn of specific color selected by the pattern control means.

Therefore, in accordance with this invention, on the pile surface of tufted carpet there is duplicated colorful pattern classifed by the color of several sets of pile yarns of different color, by selectively seizing a loop of pile yarn with the looper of tufting machine in every periodic time of a stop and feed motion of intermittent feed apparatus.

Also the lateral width of conventional tufting machine is generally about 3~6 meters, and several thousands of needles and loopers are laterally aligned in parallel to each other, so that, in case that the width of the tufting machine are divided into several divisions, for example, three divisions composed of the right portion, the middle portion and the left portion, and in case that pile yarns of several sets of different colors are threaded into the needles of each division by varying the set of pile yarn in accordance with those three divisions, a wide and very colorful pattern, whose width is similar to that of the tufting machine, can be duplicated on the pile surface.

Because, the number of colors of the sets of pile yarns is not limited by that of needle stroke cycles of the periodic time of the intermittent feed apparatus.

The formation of pile such as cut pile and loop pile and the pile height are partially variable in a pattern in a conventional manner, for example, the pile height can be varied by using the looper having two portions for seizing a loop of pile yarn or by controling the length of yarn fed to the needle in each needle stroke cycle.

In order to form selectively a cut pile and a loop pile, a looper is selectively moved in the looper block being pushed out or drawn in, the gate member is applied to a looper, or a looper with a clip is applied to tufting machine.

Therefore, the scope of the present invention is not limited by those applications.

DETAILED DESCRIPTION OF THE PREFERRED EMBODIMENT

Tufting machine shown in FIG. 1, is made by modifying a conventional tufting machine which is sold at the above mentioned Cobble Tufting Machine Company and has the needle select means, and by applying the needle shift means and the intermittent feed means to it.

The needle select means is supported on and between the spaced slide brackets which are laterally and slidably supported by both upper and lower lateral counter shafts 11 and 11' mounted on and pushed out from the counter frame brackets of both sides of the tufting machine.

The needle shift means is composed of the disc-cam 13 and the lateral slide beam 14 shifted laterally by the disc-cam 13.

The lateral slide beam 14 is fixed on the slide bracket 12, so that the needle shift means is laterally driven by the disc-cam 13.

The disc-cam 13 is driven by the main shaft and rotates once every eight needle stroke cycles.

The tracks of the disc-cam 13 composed of four portions which are illustratively described for a cycle of eight needle strokes;

the first portion for laterally shifting the needle selecting means as a unit to be driven forward in the lateral direction for first three needle stroke cycles in the periodic time of a stop and feed motion of intermittent feed apparatus, a distance equivalent to one needle gauge every one needle stroke cycle, the second portion for stopping the needle select means not to be driven in the lateral direction for one needle stroke cycle after the first three needles stroke cycles, the third portion for laterally shifting the needle select means as a unit to be driven backward in the lateral direction for next three needle stroke cycle after above one needle stroke cycle, and the fourth portion for stopping the needle select means in the same manner of above second portion.

The servo-moter 15 is applied to the intermittent feed means.

Numeral 16 designates a senser for distinguishing the shifted portion of the needle select means and for providing a signal 51, in accordance with the distinguished portion, to the servo-moter 15.

The servo-moter 15 is operated, in response to the signal provided by the senser 16, to stop the fabric feed roll 17 and the take-up roll (not shown) for three needle stroke cycles while the needle select means is shifted, and to rotate them within one needle stroke cycle while the needle select means is not shifted and stationary.

The needle select means is composed of needle push bar 18, stop member 19, holder guide bars 20, 21 and 22, a plurality of elongated needle holders, a plurality of air cylinder 24, and pattern control means 25.

The needle holders are laterally aligned through the spaces vertically formed with needle push bar 18 and holder guide bars 20, 21 and 22.

For purposes of explanation, in FIG. 1 there is shown only one of a plurality of needle holders designated by numeral 23.

Each space between the adjacent needle holders is arranged, at the same gauge with one another, by means of the vertical elongated guide channel 26 formed on the surfaces of needle push bar 18 and holder guide bars 20, 21 and 22 which the needle holder comes into contact with.

Both side ends of needle push bar 18 are fixed to the upper portions of the vartical slide brackets 28 vartically driving in the vertical connecting post 27 mounted on and carried with the slide bracket 12.

Both side ends of holder guide bars 21 and 22 are fixed to the under portions of the vertical slide brackets 28 and 28'.

Therefore, the needle push bar 18 and the holder guide bars 21 and 22 are vertically movable.

Both side ends of the holder guide bar 20 and those of the stop member 19 are fixed to the angle bars, only one of which is shown by numeral 29 and the other of left side is not shown, fixed on the spaced slide brackets 12 and 12', and the holder guide bar 20 and the stop member 19 are not vertically driven.

Therefore, the angle bars disposed on the right side and the left side respectively are connected to each other through the holder guide bar 20, the stop member 19, and the yarn guides 31, 32 and 33.

The under end portion of each elongated needle holder 23 is connected to the stop member 19 with and through the coil spring 30.

Numerals 34 and 35 designate the slots opened on every holder guide bar respectively, and the coil spring 30 is penetrating those slots 34 and 35 on the upper surface of the needle push bar 18.

There is laterally formed a dovetail-tenon on the needle push bar 18, which is laterally and slidably fit into the corresponding dovetail channel 38 formed on the under surface of the undercutting flange bar 37 mounted on and carried vertically by the push rod 36.

Therefore, the push rod 36 can vertically reciprocate the needle push bar 18 and the holder guide bars 21 and 22, but does not stand in the way of lateral shifting movement of the needle select means.

According to the signal 53 provided by the pattern control means 25, every air-cylinder 24 mounted on the needle push bar 18 drives the latch pin 39 to be pushed into or withdrawn from the corresponding latch aperture 40 formed on each elongated needle holder 23.

That is, the needle holder 23 is connected to the needle push bar 18 by pushing the latch pin 39 into the corresponding latch aperture 40, and thereby the needle 41 mounted on the lower end of the needle holder 23 is pierced into the backing fabric.

Numeral 42 designates a looper for seizing a loop of pile yarn presented by the needle, and numeral 43 designates a knife for cutting and changing the loop of pile yarn into a cut pile by cooperating with the looper.

Numeral 44 designates a sensor for distinguishing the shifted portion of the needle select means and for providing a signal 52, in accordance with the distinguished portion of the needle select means, to the pattern control means.

For the air-cylinder 24 pattern control means 25 provides a signal 53 composed of two signals; one signal which is provided by the sensor 44, corresponding to the shifted position of the needle select means, and the other signal 54 which corresponds to the pattern 45.

As mentioned above, over three needle stroke cycles the backing fabric is held stationary without being longitudinally fed by the servo-motor 15, the fabric feed roll, and the take up roll, and then longitudinally is fed in one needle stroke cycle just after the stop.

And, all needles carried on the needle select means are laterally shifted one gauge in each one of the following three needle stroke cycles during the time that the backing fabric is held stationary without being longitudinally fed.

FIGS. 2~6 show the tufting process on the tufting machine, arranged as mentioned above, for duplicating a pattern on the pile surface formed from four sets of pile yarns P, Q, R and S colored in different colors from one another, each color of which is designated as black color, white color, obliquelines and dots respectively.

Figure 2:
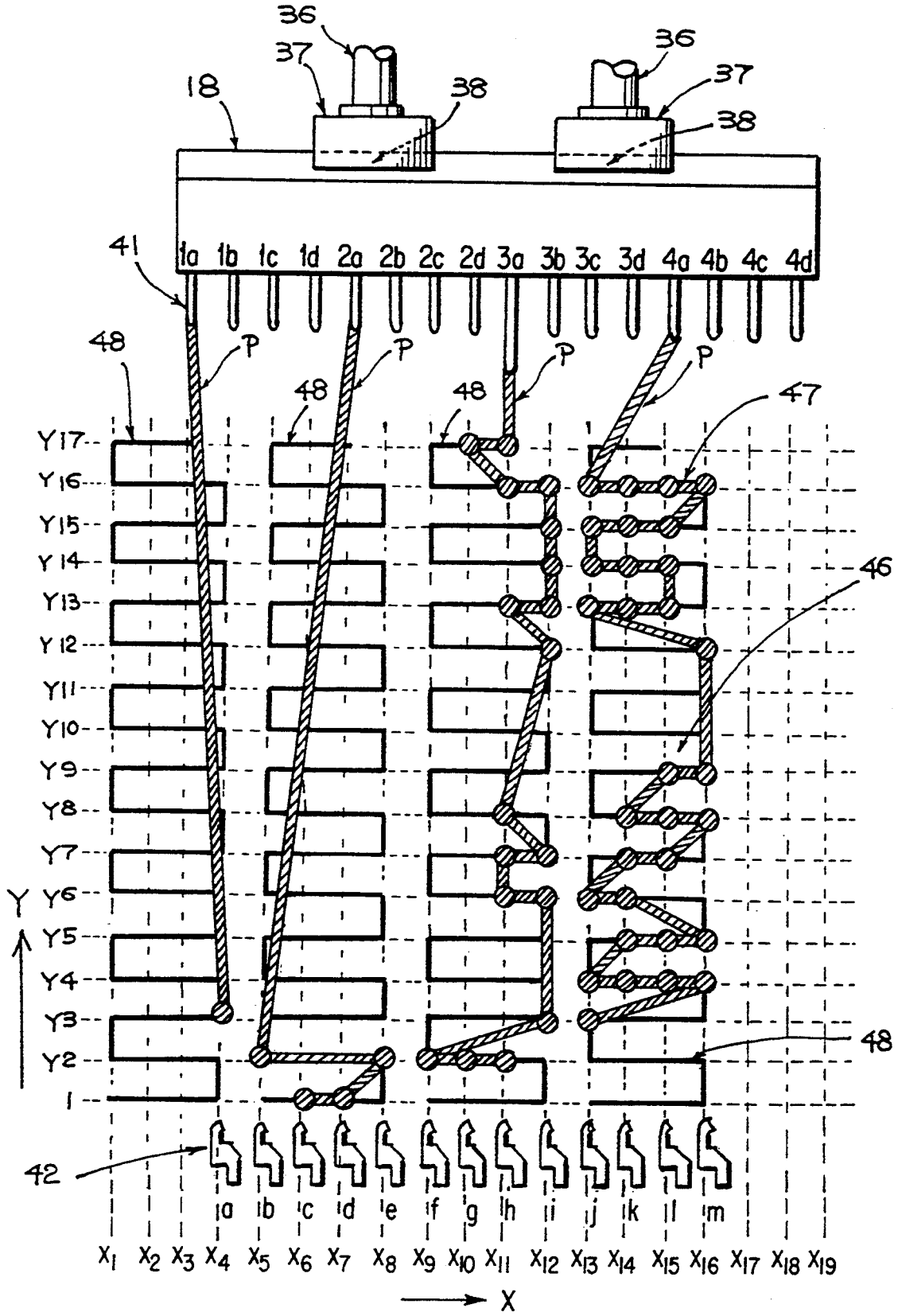
FIGS. 2, 3, 4 and 5 are fragmentary views of the reverse side surface of the tufted carpet formed in accordance with this invention respectively, which show the loci drawn on the backing fabric by the needles threaded with the pile yarns having a different color and the back-stitchs formed from these pile yarns, and these figures are illustrated respectively classified in accordance with the color of pile yarn.
Figure 3:
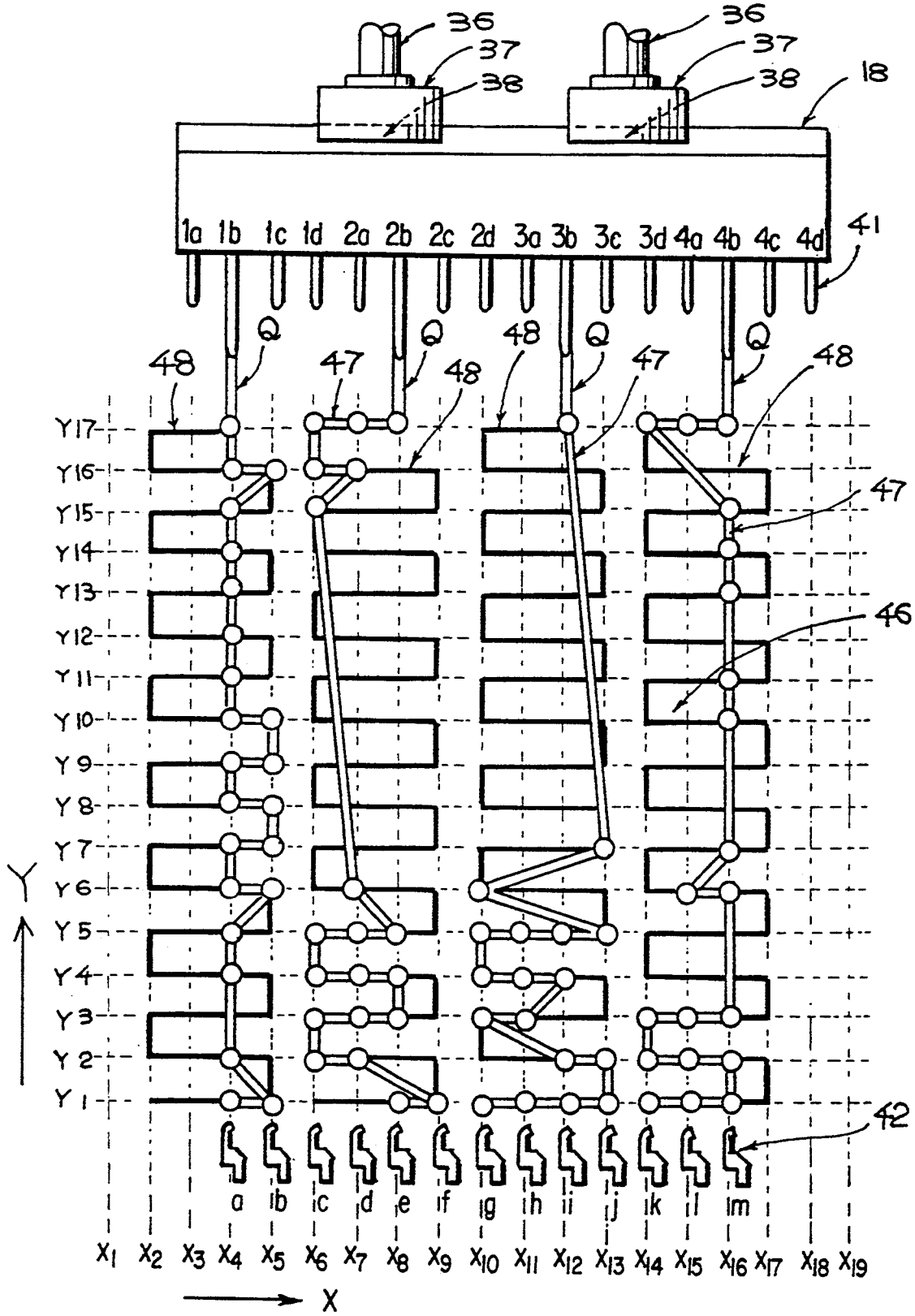
Figure 4:
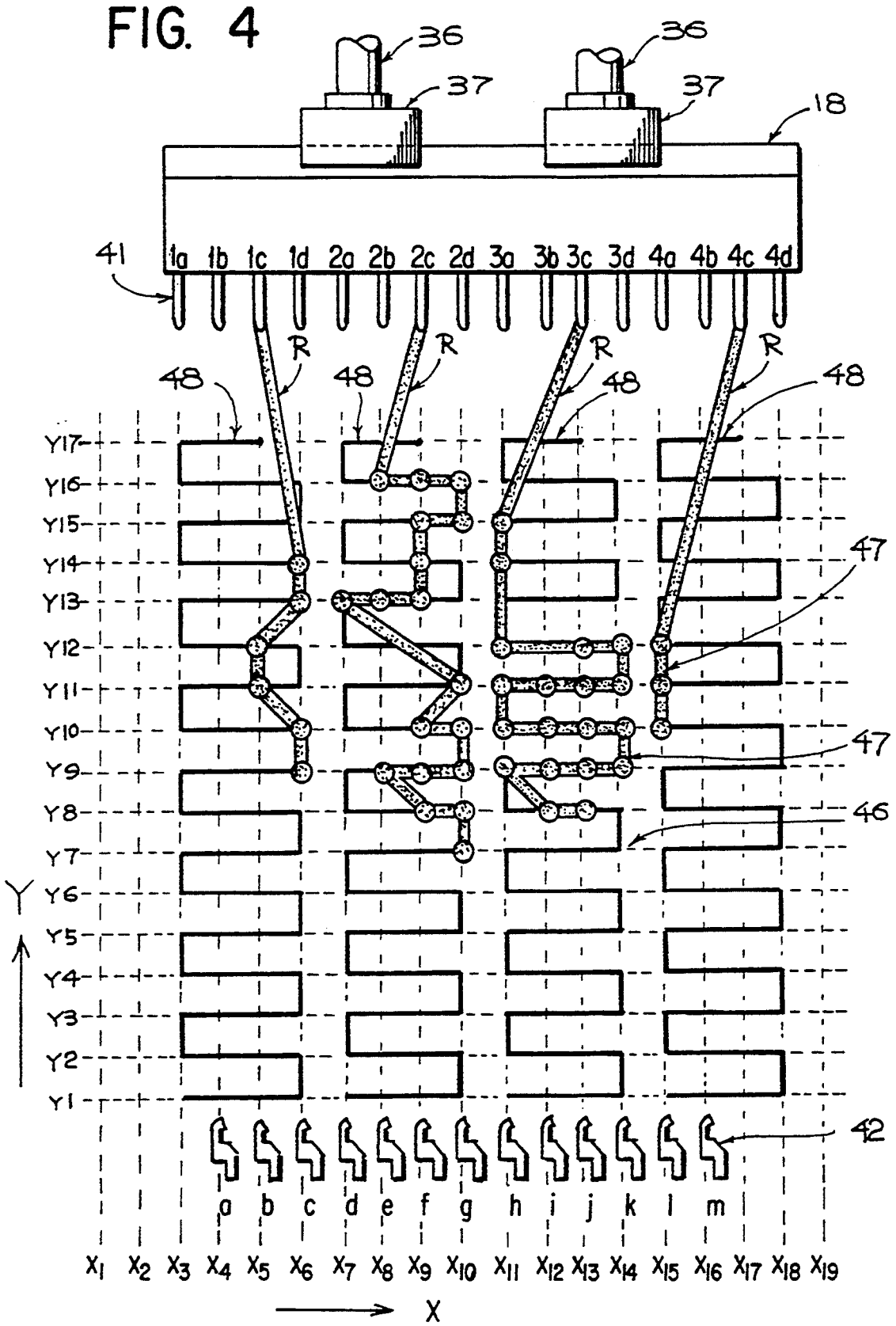
Figure 5:
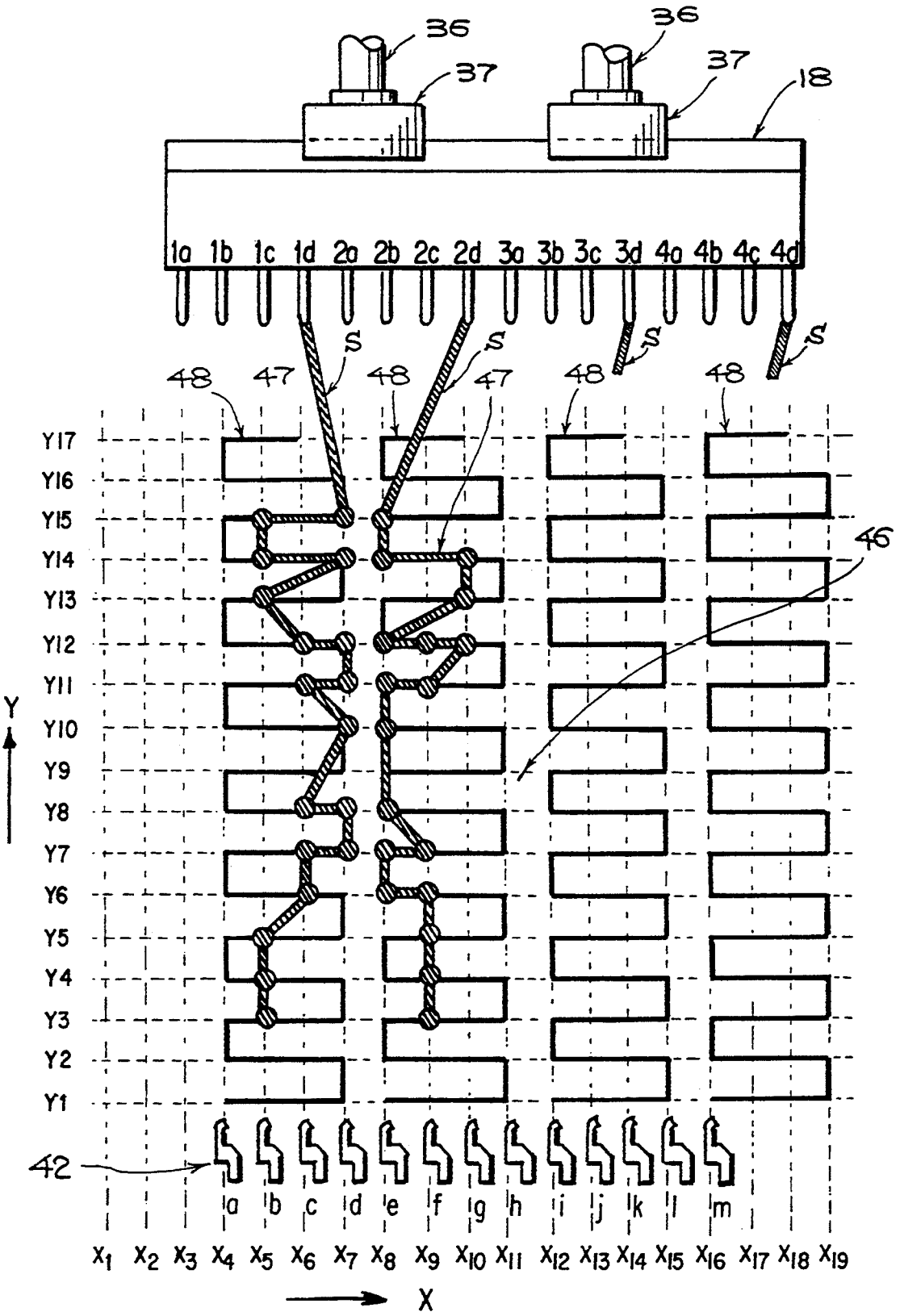

That is, FIG. 2 shows the tufting process with the pile yarns P designated as black color, FIG. 3 shows the tufting process with the pile yarns Q designated as white color, FIG. 4 shows the tufting process with the pile yarns R designated as obliquelines, and FIG. 5 shows the tufting process with the pile yarns S designated as dots.

Figure 6:
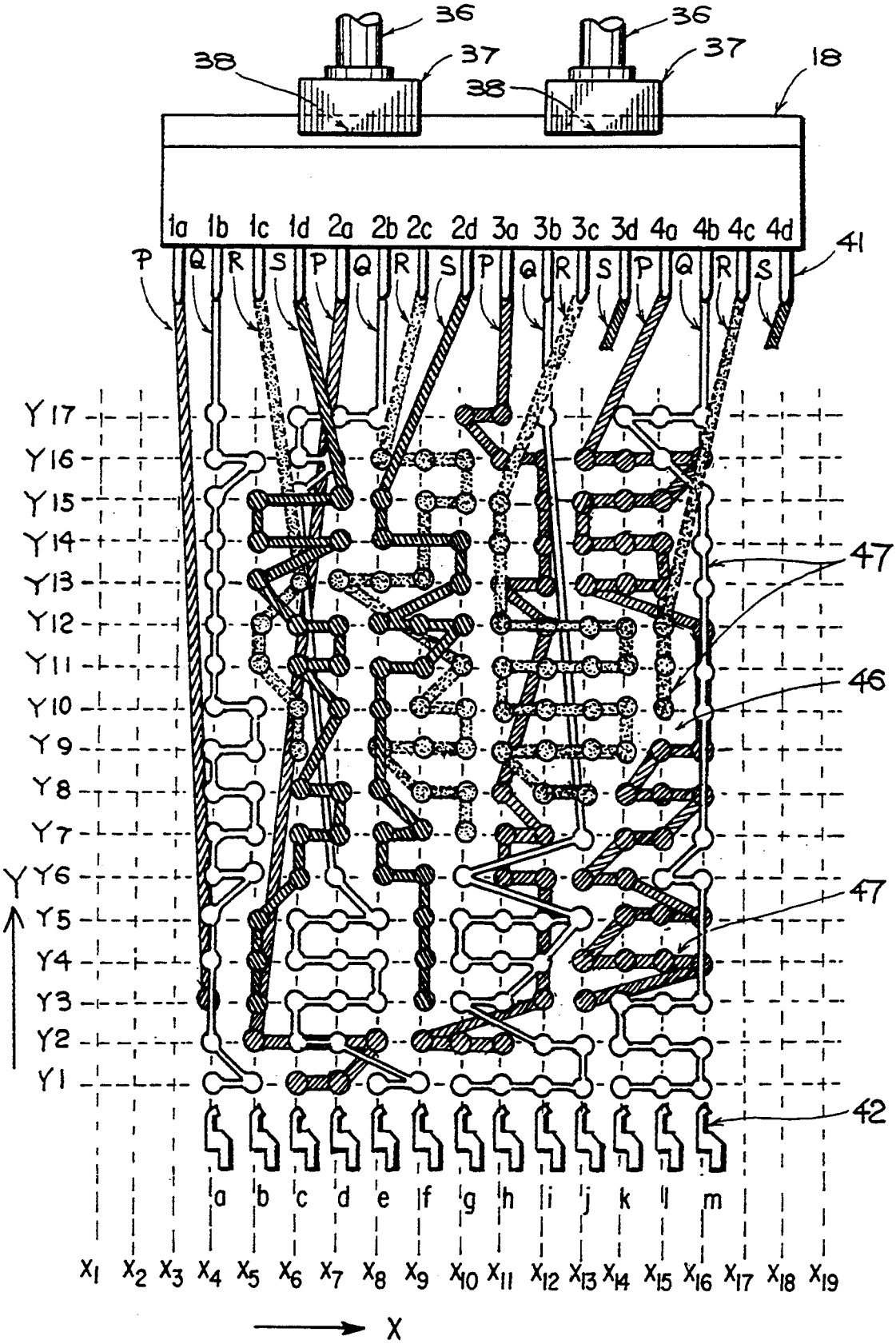
FIG. 6 is a fragmentary view of the reverse side surface of the tufted carpet formed from several kinds of pile yarns different in color with this invention.

FIG. 6 shows the reverse surface of the tufted carpet 50 composed of those four sets of pile yarns P, Q, R and S in different color.

In each figure, sixteen needles, shown by numerals 1*a*, 1*b*, 1*c*, 1*d*, 2*a*, 2*b*, 2*c*, 2*d*, 3*a*, 3*b*, 3*c*, 3*d*, 4*a*, 4*b*, 4*c* and 4*d*, and sixteen loopers, shown by numerals a, b, c, d, e, f, g, h, i, j, k, l and m, are arranged laterally at the same regular gauge between adjacent ones respectively, and those needles and loopers are adapted to be brought into the tufting engagement during seventeen periodic times of a stop and feed motion of the intermittent feed means, and each looper is operative to seize only one loop of pile yarn to form a pile every periodic time of a stop and feed motion of the intermittent feed means.

For purposes of explanation, there are designated the tufting portion on the backing fabric, where each pile should be formed, by the coordinates composed of ordinates Y, which correspond to the longitudinal direction of the backing fabric and designate a step or periodic time of a stop and feed motion of the intermittent feed means, and abscissas X, which correspond to the lateral direction of the backing fabric and designate a looper or needle gauge.

That is, the lateral direction of the backing fabric is graduated with a looper or needle gauge (X1, X2, X3, X4, X5, X6, X7, X8, X9, X10, X11, X12, X13, X14, X15, X16, X17, X18 and X19) and the longitudinal direction of the backing fabric is graduated with a length of the backing fabric fed in each periodic time of a stop and feed motion (Y1, Y2, Y3, Y4, Y5, Y6, Y7, Y8, Y9, Y10, Y11, Y12, Y13, Y14, Y15, Y16 and Y17).

In each figure, the mark ◯ designate the portions on the backing fabric where the pile yarns P, Q, R or S have been pierced and have formed a pile, and thick lines, which are connecting between two portions designated with the mark ◯, designate the back-stitchs, shown by numeral 47, formed from pile yarns on the reverse of the tufting carpets.

In FIGS. 2, 3, 4 and 5, relatively thick lines, which are longitudinally elongated in a zig-zag manner, designate the loci drawn on the backing fabric by a single needle in accordance with the movement of backing fabric and needle.

The pile yarns of four sets P, Q, R and S of different colors in turn are threaded into every respective different four needles, in accordance with the differences of those sets classified by colors, and it is selected for each pile yarn in each needle stroke cycle whether to form a pile or not.

It will be apparent from the figures that all loopers, shown by numerals a, b, c, d, e, f, g, h, i, j, k, l and m, are disposed in the positions to seize four loops of pile yarns carried by the different four needles (1*a*, 1*b*, 1*c*, 1*d*, 2*a*, 2*b*, 2*c*, 2*d*, 3*a*, 3*b*, 3*c*, 3*d*, 4*a*, 4*b*, 4*c* and 4*d*), in each periodic time of a stop and feed motion, in a usual manner wherein each looper seizes one loop of pile yarn in each needle stroke cycle, that is, the looper (a) seizes a loop carried by the needles 1*a*, 1*b*, 1*c* and 1*d*, the looper (b) seizes a loop carried by the needles 1*b*, 1*c*, 1*d* and 2*a*, the looper (c) seizes a loop carried by the needles 1*c*, 1*d*, 2*a* and 2*b*, the looper (d) seizes a loop carried by the needles 1*d*, 2*a*, 2*b* and 2*c*, the looper (e) seizes a loop carried by the needles 2*a*, 2*b*, 2*c* and 2*d*, the looper (f) seizes a loop carried by the needles 2*b*, 2*c*, 2*d* and 3*a*, and the like.

However, in accordance with this invention, each looper seizes only one loop of pile yarn from the selected one of those different four needles.

Therefore, on the pile surface there is duplicated a pattern classifyed with at least four different colors, because those pile yarns (P, Q, R and S) threaded into and carrying by those four needles 1*a*, 1*b*, 1*c* and 1*d* (2*a*, 2*b*, 2*c* and 2*d*), (3*a*, 3*b*, 3*c* and 3*d*), (4*a*, 4*b*, 4*c* and 4*d*) have different colors from one another.

Figure 7:
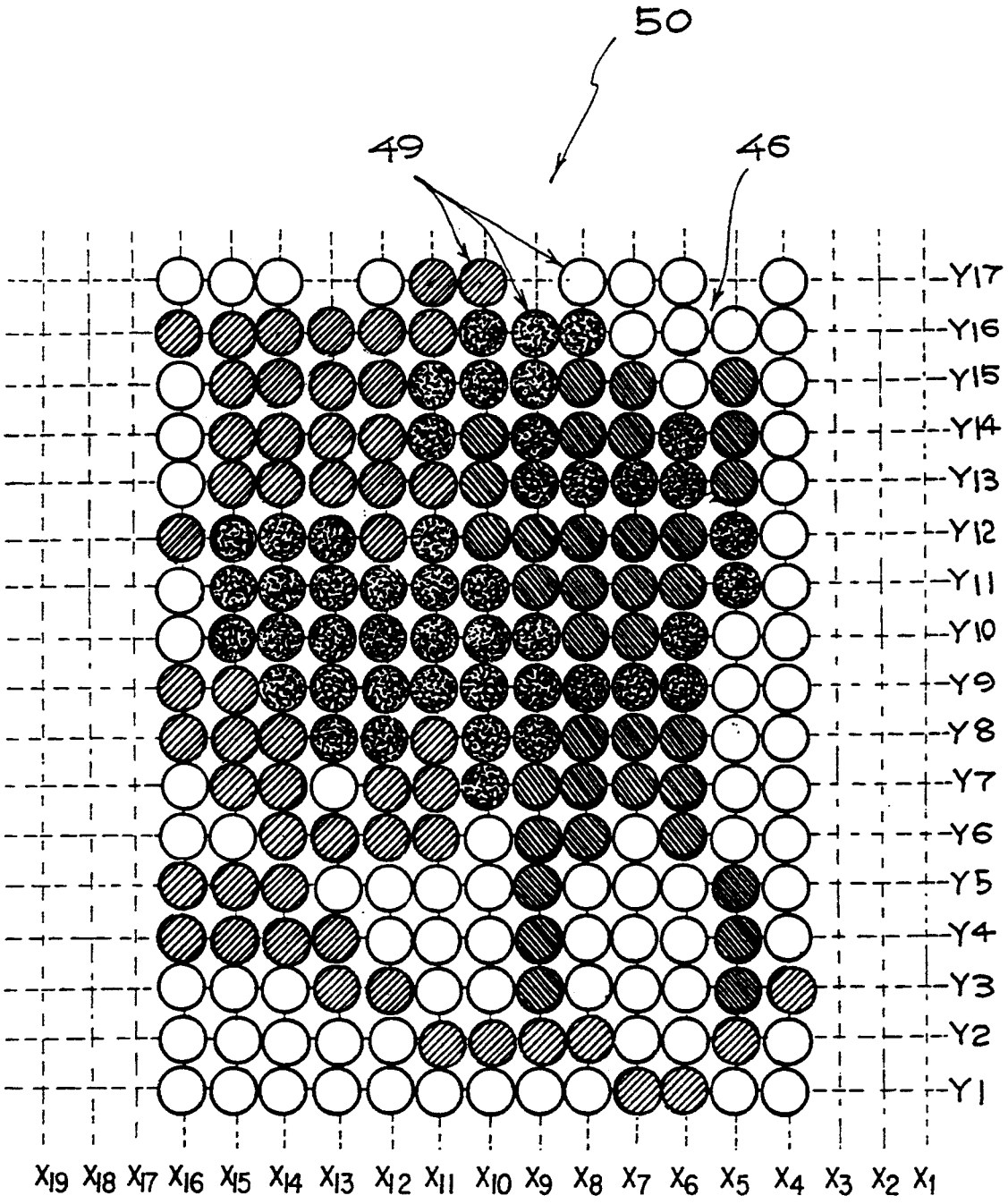
FIG. 7 is a fragmentary view of the pile surface of the tufted carpet formed from several kinds of pile yarns different in color with this invention.

FIG. 7 shows the pile surface formed over the reverse side of the reverse surface of tufting carpet shown in FIG. 6, wherein both left and right sides of abscissas are reversed between FIG. 6 and FIG. 7, and every extreme portion 49 of pile is designated as black color, white color, obliquelines and dots corresponding to FIGS. 2, 3, 4, 5 and 6.

According to those FIGS. 2, 8, 4, 5, 6 and 7, it will be easily understood that the very colorful pattern will be duplicated on the pile surface of the tufting carpet 50.

I claim:

1. A tufting machine for operating on a fabric backing comprising:

a plurality of needles each for carrying a pile yarn aligned laterally relative to one side of said fabric backing with a regular gauge between adjacent needles, a plurality of loopers aligned laterally relative to the other side of the fabric backing with the same gauge between adjacent loopers as said regular gauge of the needles, needle select means for selecting certain of said needles at every needle stroke cycle and for inserting said selected needles into the backing fabric, pattern control means for providing a signal for actuating said needle select means to select the needles to be inserted during each of said needle stroke cycles, feed means for intermittently and longitudinally feeding said backing fabric in a stop and feed manner wherein said backing fabric remains stationary in the longitudinal direction during a stopping period which is at least one needle stroke cycle in duration and can be fed during a succeeding feeding period, and shift means for aligning selected ones of said needles each with any one of an associated plurality of said loopers by lateral shifting of said needles relative to both said backing fabric and said loopers by a distance equal to an integral number n, where n is equal to or greater than 1, of the regular needle gauge for every needle stroke cycle while said backing fabric remains stationary in the longitudinal direction, said pattern control means providing said needle select means with a signal so that any one of said needles may be selected, inserted and the pile yarn carried thereby brought into tufting engagement with a corresponding one of the loopers disposed in alignment under said inserted needles to enable said one of the loopers to seize only one loop of pile yarn during at any one needle stroke cycle for each stopping period of a stop and feed motion of said intermittent feed means.

2. A tufting machine as in claim 1 wherein said shift means shifts said needles relative to said backing fabric by a distance equal to one needle gauge.

3. A tufting method for producing designs in carpeting made on a fabric backing which comprises:

providing a plurality of needles each for carrying a pile yarn aligned laterally relative to one side of said fabric backing and with a regular gauge between adjacent needles, providing a plurality of loopers aligned laterally relative to the other side of the fabric backing and having the same gauge between adjacent loopers as said gauge of needles, selecting at every needle stroke cycle the needles for insertion and inserting the selected needles into the backing fabric during a needle stroke cycle, actuating the selection of the needles for insertion, intermittently and longitudinally feeding said backing fabric in a stop and feed manner wherein said backing fabric remains stationary in the longitudinal direction during a stopping period of at least one needle stroke cycle in duration and can be fed during a succeeding feeding period, and aligning selected ones of said needles each with any one of an associated plurality of said loopers by lateral shifting of said needles relative to both said backing fabric and said loopers by a distance equal to an integral number n, where n is equal to or greater than 1, of the needle gauge with a shift means during every needle stroke cycle before inserting said needles in the backing fabric during each of said needle stroke cycles, and actuating each looper to seize only one loop of pile yarn from an aligned one of said needles inserted into said backing and disposed over said looper for seizing only one said loop of pile yarn during any one needle stroke cycle for each stopping period of a stop and feed motion of said intermittent feed means.

4. A method as in claim 3 wherein the step of shifting comprises shifting the needles relative to the backing fabric by a distance equal to one needle gauge.

* * * * *